US005474375A

United States Patent [19]

Hollenstein et al.

[11] Patent Number: 5,474,375

[45] Date of Patent: Dec. 12, 1995

[54] CLOSING DEVICE FOR MOVING A DRAWER TO A FULLY INSERTED POSITION WITHIN A FURNITURE BODY

[75] Inventors: Helmut Hollenstein, Lustenau; Emanuel Netzer, Höchst, both of Austria

[73] Assignee: Julius Blum Gesellschaft m.b.H., Höchst, Austria

[21] Appl. No.: 257,058

[22] Filed: Jun. 8, 1994

[30] Foreign Application Priority Data

Jun. 23, 1993 [AT] Austria ..... 1239/93

[51] Int. Cl.[6] ..... A47B 88/04

[52] U.S. Cl. ..... 312/319.1; 312/333

[58] Field of Search ..... 312/333, 334.8, 312/334.9, 334.11, 334.32, 334.33

[56] References Cited

U.S. PATENT DOCUMENTS

| | | | |
|---|---|---|---|
| 4,560,212 | 12/1985 | Papp et al. | 384/18 |
| 5,207,781 | 5/1993 | Röck | 312/319.1 |
| 5,292,198 | 3/1994 | Röck et al. | 312/333 X |
| 5,302,016 | 4/1994 | Lautenschläger et al. | 312/333 |
| 5,344,226 | 9/1994 | Lee | 312/333 X |
| 5,364,179 | 11/1994 | Brüstle et al. | 312/333 |

FOREIGN PATENT DOCUMENTS

92/00027 1/1992 WIPO .

*Primary Examiner*—Kenneth J. Dorner
*Assistant Examiner*—Rodney B. White
*Attorney, Agent, or Firm*—Wenderoth, Lind & Ponack

[57] ABSTRACT

A closing device is employed in an article of furniture having furniture components including a furniture body and a drawer for moving the drawer to a fully inserted position within the furniture body. The closing device includes a pin member fixed to the drawer and a tiltable member mounted on the furniture body. The tiltable member is displaceable along a guide track in opposite directions. The pin member and the tiltable member are engaged with the drawer is in its fully inserted position. The pin member is held in a slot of the tiltable member. A spring acts on the tiltable member. When the pin and the tiltable member are in engagement, the spring urges to the drawer to move in a direction inwardly of the furniture body to the fully inserted position. When the tiltable member displaced relative to the other furniture component against the force of the spring to a predetermined position, the tiltable member is caused to tilt about an axis to a locking position whereat the tiltable member is locked with respect to the furniture body and engagement between the pin member and the tiltable member is released. The pin member is elongated in cross section. The width of the slot in the tiltable member is equal to the length of the cross section of the pin member, and the depth of the slot is larger than the width of the pin member.

8 Claims, 3 Drawing Sheets

19
10
21

X
15
10
11
23
16
12
22
20
17
18

13

CLOSING DEVICE FOR MOVING A DRAWER TO A FULLY INSERTED POSITION WITHIN A FURNITURE BODY

BACKGROUND OF THE INVENTION

The present invention relates to a closing device, for use in an article of furniture having furniture components including a furniture body and a drawer slidable in opposite directions into and out of the furniture body, for moving the drawer to a fully inserted position within the furniture body. The closing device includes a pin member adapted to be fixedly mounted on one of the furniture components, and a tiltable member adapted to be guided on a housing mounted on the other of the furniture components for displacement relative thereto in opposite directions. The tiltable member is supported by a slide. A spring acts on the slide and causes rectilinear displacement of the slide and the tiltable member. Thereby, when the pin member and the tiltable member are in engagement, the drawer is used to move in a direction inwardly of the furniture body to the fully inserted position. The tiltable member has therein a slot. The pin member extends into the slot when the tiltable member is positioned in its position for rectilinear movement. Engagement between the pin member and the tiltable member is released when the tiltable member is in a tilted position thereof.

Modern drawers normally are provided with pull-out guide assemblies on each of opposite sides of the drawer. Each such pull-out guide assembly includes a supporting rail on the furniture body and a pull-out rail on the drawer. The pull-out guide assemblies are designed to ensure that the movement of the drawer into and out of the furniture body will be easy and as smooth as possible. Conventionally rollers, balls or slides are provided for transmitting the load of the drawer from the pull-out rails to the supporting rails of the furniture body. Such arrangements are adapted to the requirements of a particular drawer with respect to smoothness of operation and loading capacity.

It has been found that a drawer that has been moved to a closed position sometimes will not be in its fully closed rear end position, i.e. fully inserted into the furniture body, such that a front plate or an end of the drawer projects from the furniture body. As a result it is possible for persons to bump against the front of the drawer, and consequently damage to the drawer or injury of such persons may occur. Projection of the front plate of the drawer from the front of the furniture body may occur when the drawer has been pushed into the furniture body without care or not to the full extent. Also when the drawer has been pushed into the furniture body with too much energy, the drawer may again roll forwardly or rebound because of such excessive energy.

A closing device for a drawer is disclosed in GB-PS 1 117 071 wherein there is provided a tilting member or part which is movable between two end positions. The tilting member is acted upon by a coil spring and thereby is urged into respective end positions after having moved past a dead center position. The tilting member is fastened to a side wall of the furniture body, and the drawer is provided with the driving pin member which is inserted into a notch or slot in the tilting member during an end portion of the path of movement of the drawer. The driving pin member then moves the tilting member past the dead center position, whereupon the tilting member itself pulls the driving pin member and thus the drawer toward the rear of the furniture body under the action of the coil spring.

In U.S. Pat. No. 5,207,781 is disclosed a closing device which can pull a drawer over a longer distance into an article of furniture. This closing device also employs a tilting member, but such tilting member not only tilts but travels on a guide track having a rectilinear rear portion. A similar device is shown in WO-A1-92/00027.

While ordinary functioning of such a closing device is very good, it can occur that, when the supporting rails and the pull-out rails are not exactly positioned with respect to each other, the pin member does not always engage precisely into the slot of the tilting member. This problem especially arises when the pull-out guide assembly features an intermediate rail positioned between the pull-out rail and the supporting rail.

SUMMARY OF THE INVENTION

With the above discussion in mind, it is an object of the present invention to provide a closing device of the before mentioned kind in which a pin member can more easily engage with a tilting member so that small inaccuracies in mounting the rails on the article of furniture and the drawer can be tolerated.

This object is achieved in accordance with the invention by the pin member being elongated in cross section, the width of the slot in the tiltable member being equal to the length of the cross section of the pin member and the depth of the slot being larger than the width of the pin member.

DETAILED DESCRIPTION OF THE INVENTION

Figure 3:
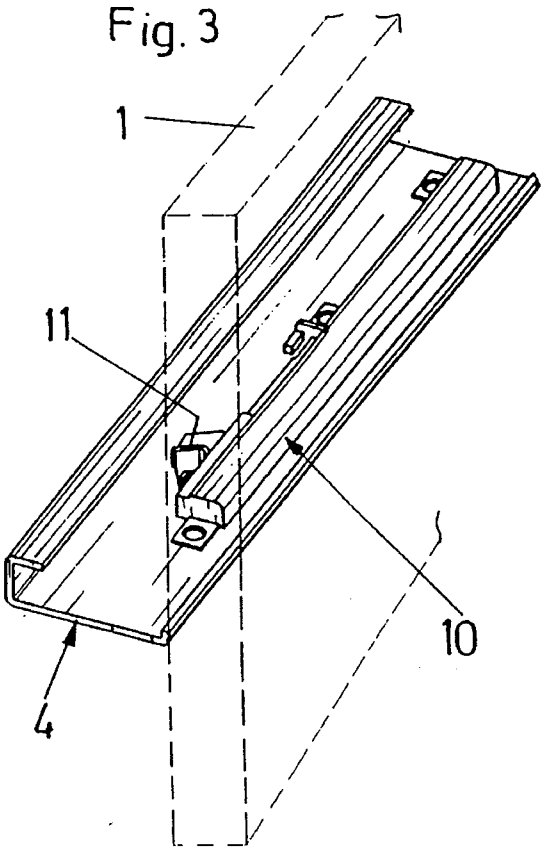
FIG. 3 is a perspective view of the side wall of the article of furniture and a supporting rail with a closing device according to the invention.
Figure 2:
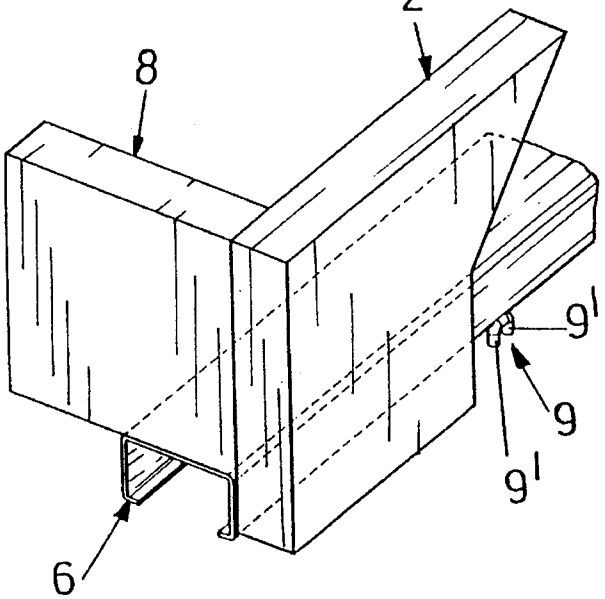
FIG. 2 is a perspective view of a rear corner of the drawer.
Figure 1:
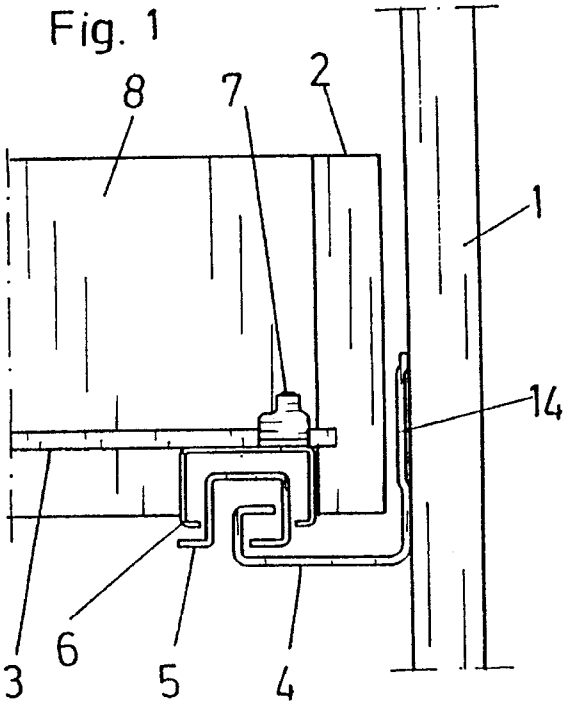
FIG. 1 is a rear view of a drawer rear wall, a drawer side wall and a side wall of an article of furniture.
Figures 4, 5, 5A:
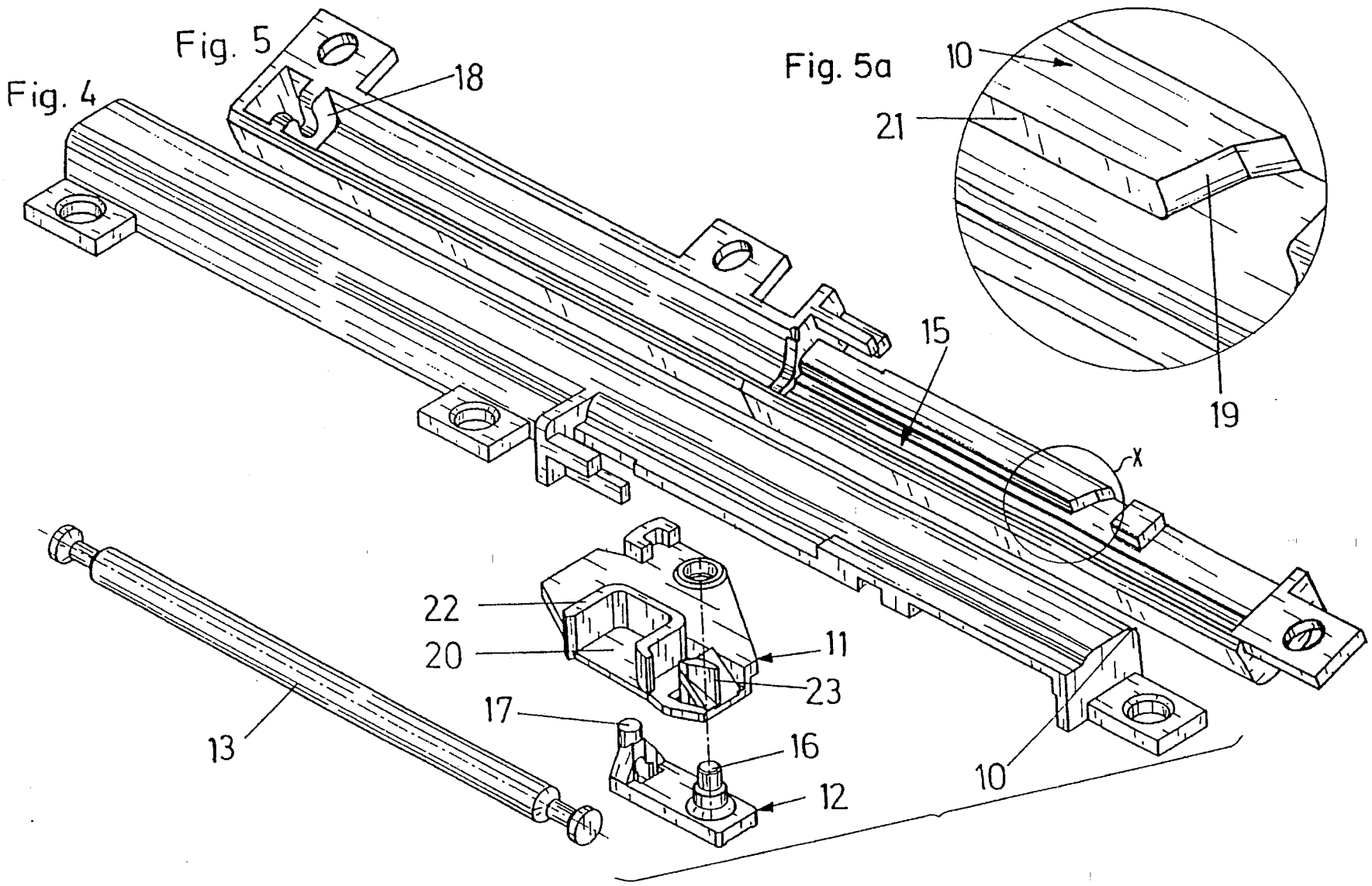
FIG. 4 is an exploded perspective view of parts of the closing device.
FIG. 5 is a perspective view of a housing of the closing device as seen from below.
FIG. 5*a* is an enlarged view of detail X in FIG. 5.

In the embodiment shown, a pull-out rail 6 is mounted underneath a bottom plate 3 of a drawer and next to a drawer side wall 2. On its rear end, the pull-out rail 6 is provided with a hook 7 which protrudes into a hole in a rear wall 8 of the drawer. A supporting rail 4 is mounted on a side wall 1 of an article of furniture, e.g. by means of flaps 14. An intermediate rail 5 is positioned between the supporting rail 4 and the pull-out rail 6. The intermediate rail 5 can be moved relatively to both rails 4, 6. Carriages for rollers are situated between the rails 4, 5, 6 but are not shown in the drawings. Also, rollers could be mounted directly on the rails 4, 5, 6. However, a pull-out guide assembly featuring rollers mounted in separate roller carriers provides very smooth running features.

At the rear of the pull-out rail 6 is provided a pin member 9. In the embodiment shown, the pin member 9 is a U-shaped bolt with two studs 9'. A housing 10 of the closing device is mounted on the rear end of the supporting rail 4. A slide 12 is situated in the housing 10. The slide 12 is movable along a groove of the housing 10, such groove acting as a guide track 15. The slide 12 has two guide rods 16, 17 extending into the guide track 15. One guide rod 16 also acts as a trunnion for a tiltable member 11. A spring 13 is fastened to the slide 12 and to a web 18 of the housing 10. The spring 13 is a helical spring and tension spring. At the front end of the guide track 15 a shoulder 19 is provided on the housing 10 next to the guide track 15.

Figure 6:
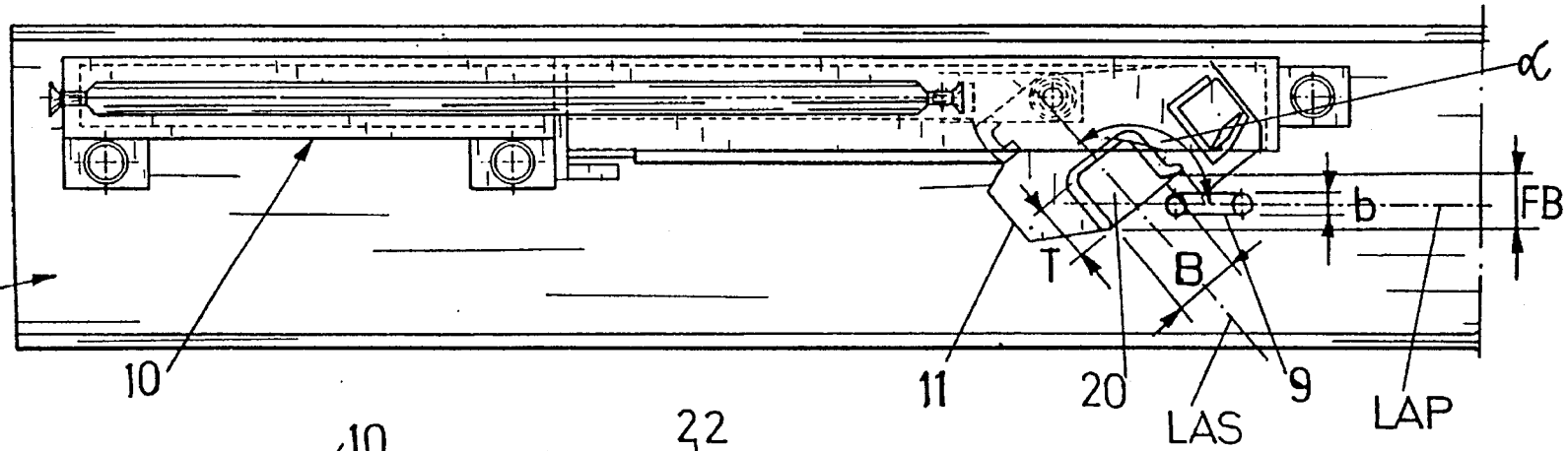
FIG. 6 is a top view of the closing device of the invention, a tilting member thereof being in a position before a pin member engages therewith.

If the drawer is in its fully inserted position, the tiltable member 11 is situated at the rear end of the guide track 15 and the pin member 9 engages into a slot 20 of the tiltable member 11. When the drawer is pulled out, the tiltable member 11 together with the slide 12 is moved in direction of the arrow in FIG. 7, i.e. to the right as shown therein. Tilting of the tiltable member 11 is prevented by a track 21 on the housing 10 so that the tilting element 11 is moved in a straight line. When the tiltable member 11 is situated next to the shoulder 19, the pin member 9 presses the tiltable member 11 to tilt or pivot the outside and the tiltable member 11 is locked behind the shoulder 19 as shown in FIG. 6 so that the spring 13 cannot pull the tiltable member 11 and the slide 12 to the rear. By such tilting of the tiltable member 11, the pin member 9 is disengaged from slot 20 and the drawer can be moved freely out of the piece of furniture.

Figure 7:
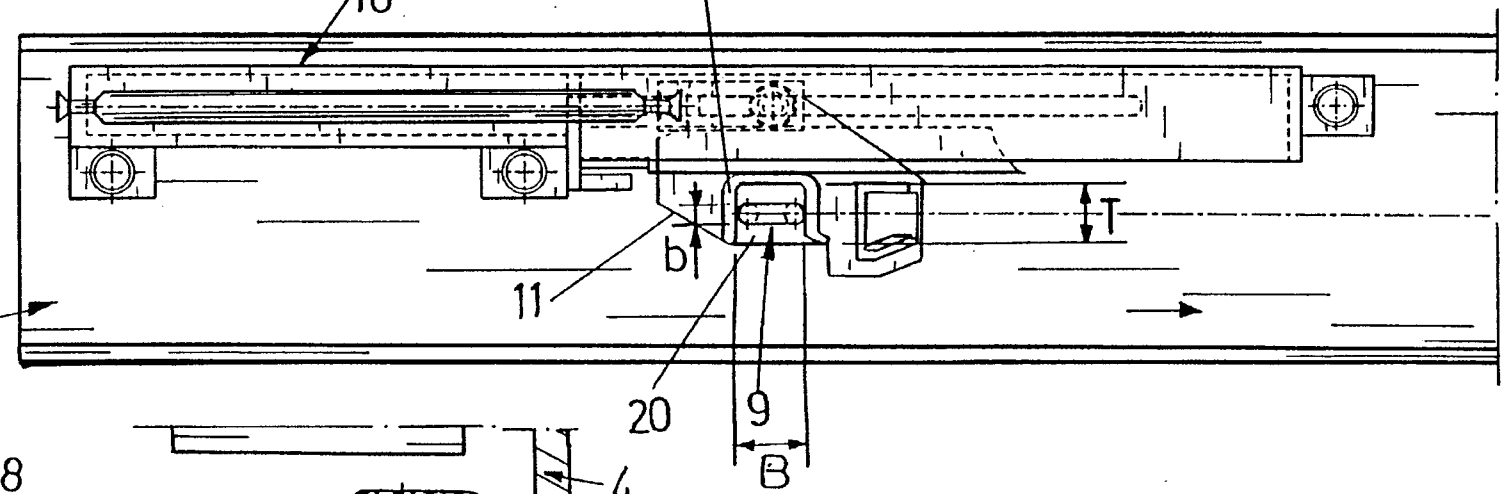
FIG. 7 is a top view of the closing device with the pin member engaging with the tilting member and the tilting member being in its rearmost position, e.g. in the position when the drawer is fully inserted into the furniture body.
Figure 8:
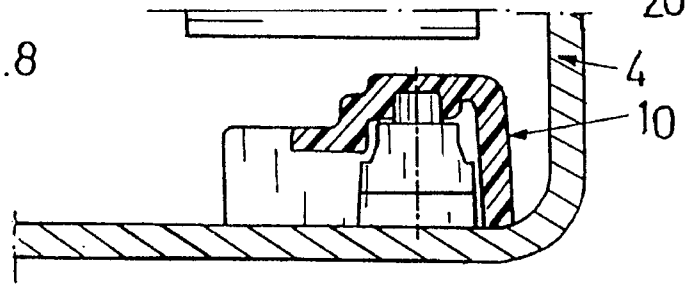
FIG. 8 is a sectional view of the supporting rail and the closing device.

As can be seen from FIG. 6 and 7, the pin member 9 is an oblong part even if it is not a continuous web but a U-bolt with two studs 9'. The slot 20 of the tiltable member 11 is defined by a rim 22. In the direction of the movement of the drawer, the pin member 9 is held within the rim 22 without clearance. The width B of the slot 20 is equal to the length of the pin member 9, but dept T of the slot is larger than the width b of the pin member 9. By this arrangement, a large dimension or range FB for the pin member 9 to enter slot 20 as shown in FIG. 6 is obtained. As long as the pin member 9 is situated within the pull-in range FB, it will engage in the slot 20 of the tiltable member 11 when abutting tiltable member 11.

Before the pin member 9 engages in the slot 20, when the tiltable member 11 is in the tilted position and rests against the shoulder 19 of the housing 10, a longitudinal axis LAP of the pin member 9 and a longitudinal axis LAS of the slot 20 define an obtuse angle $\alpha$ of approximately 130°.

The tiltable member 11 is also provided with an elastic flap 23, which can be overtravelled by the pin member 9 when the tiltable member 11 and the slide 12 have been moved to the rear end of the guide track 15 before the pin member 9 has engaged into the slot 20 of the tiltable member 11. After the pin member 9 has overtravelled the flap 23, it engages behind the flap 23 when the drawer is pulled out, whereby the slide 12 and the tiltable member 11 can be moved to the front end of the guide track 15 so far that the tiltable member 11 is arrested by the shoulder 19. When the drawer is moved into the piece of furniture during the next closing operation, the closing device will function normally, that is, the pin member 9 will engage in the slot 20.

We claim:

1. A closing device, for use in an article of furniture having furniture components including a furniture body and a drawer slidable in opposite directions into and out of the furniture body, for moving the drawer to a fully inserted position within the furniture body, said closing device comprising:

a pin member adapted to be fixedly mounted on one of the furniture components;

a housing adapted to be mounted on the other of the furniture components;

a tiltable member supported by a slide for rectilinear movement in opposite directions relative to said housing;

said tiltable member having therein a slot and being tiltable relative to said housing between a first position, whereat said pin member extends into said slot and said rectilinear movement is enabled, and a tilted second position, whereat said rectilinear movement is prevented and said pin member is released from said slot;

a spring acting on said slide to urge said slide in a first said rectilinear direction such that, when said pin member is in said slot, said tiltable member is urged in said first rectilinear direction, whereby the drawer will be urged inwardly of the furniture body to a fully inserted position; and said pin member being elongated in a direction parallel to said rectilinear directions, said slot having a width equal to a length in said direction of said elongated pin member, and said slot having a depth greater than a width of said pin member.

2. A closing device as claimed in claim 1, wherein said pin member is defined by two studs.

3. A closing device as claimed in claim 2, wherein said two studs are formed by a U-shaped bolt.

4. A closing device as claimed in claim 1, wherein said slide has two guide rods extending into a guide track of said housing, and one of said guide rods acts as a trunnion for said tiltable member.

5. A closing device as claimed in claim 1, wherein said slot of said tiltable member is defined by a rim protruding from said tiltable member.

6. A closing device as claimed in claim 1, wherein said housing has a guide track having a shoulder, and said tiltable member abuts said shoulder when said tiltable member is in said tilted second position thereof, thereby preventing rectilinear movement thereof by said spring.

7. A closing device as claimed in claim 9, wherein said pin member has a longitudinal axis in said direction, said slot has a longitudinal center axis, and said axes extend at an obtuse angle relative to each other when said tiltable member is in said tilted second position thereof.

8. A closing device as claimed in claim 7, wherein said obtuse angle is at least approximately 130°.

* * * * *